US006485551B1

(12) United States Patent
Kohsaka et al.

(10) Patent No.: US 6,485,551 B1
(45) Date of Patent: Nov. 26, 2002

(54) METHOD OF PRINTING A POLYAMIDE STRUCTURE, SUCH A METHOD BASED ON AN INKJET SYSTEM AND AN INKSET FOR SUCH A SYSTEM

(75) Inventors: Takahiro Kohsaka, Fukui-ken (JP); Eiichi Ogawa, Saitama-ken (JP)

(73) Assignees: Seiren Co., Ltd., Fukui-ken (JP); Nippon Kayaku Kabushiki Kaisha, Tokyo (JP)

( * ) Notice: Subject to any disclaimer, the term of this patent is extended or adjusted under 35 U.S.C. 154(b) by 97 days.

(21) Appl. No.: 09/643,332

(22) Filed: Aug. 22, 2000

(30) Foreign Application Priority Data

Aug. 24, 1999 (JP) ..... 11-236572

(51) Int. Cl.[7] ..... C09D 11/00
(52) U.S. Cl. ..... 106/31.27; 106/31.58
(58) Field of Search ..... 106/31.27, 31.58

(56) References Cited

U.S. PATENT DOCUMENTS 3,961,883 A * 6/1976 Ueno et al. ..... 8/400
3,976,425 A * 8/1976 Ueno et al. ..... 8/676
4,021,196 A * 5/1977 Ueno et al. ..... 8/531
5,326,740 A * 7/1994 Kamosaki et al. ..... 428/195

FOREIGN PATENT DOCUMENTS

JP 06057650 A * 3/1994 ..... D06P/5/00
JP 9-268482 10/1997
JP 10-158560 6/1998

OTHER PUBLICATIONS

Derwent abstract of JP06057650 A, Mar. 1994.*

* cited by examiner

*Primary Examiner*—Helene Klemanski
(74) *Attorney, Agent, or Firm*—Nields & Lemack

(57) ABSTRACT

A method of printing a polyamide structure using two or more of water-soluble dye with an inorganicity/organicity value of 1 to 7 selected so that the ones with the largest and smallest inorganicity/organicity values show a difference of 2 or below between their two such values, to allow the polyamide structure to be printed with no uneven color, high color reproducibility and excellent ink bleeding prevention.

19 Claims, No Drawings

METHOD OF PRINTING A POLYAMIDE STRUCTURE, SUCH A METHOD BASED ON AN INKJET SYSTEM AND AN INKSET FOR SUCH A SYSTEM

BACKGROUND OF THE INVENTION

It has been publicly known that synthetic polyamide fiber structures are generally dyed and printed using acid dyes. The printing of polyamide fiber structures using an inkjet system has been disclosed by JP-A-6-57650 and other patents, which have proposed the use of certain acid dyes as ink for such printing.

In the meantime, patents such as JP-B2-2672346 and JP-A-188977 have proposed the use of reactive dyes for dyeing and printing natural or synthetic polyamide fiber structure.

Further in connection with the application of an inkjet system in printing a polyamide fiber structure, JP-A-9-268482 has proposed the use of certain reactive dyes as ink for such printing.

However, such prior art has the great disadvantage of not allowing the use of two or more types of water-soluble dyes in dyeing or printing polyamide fiber structure because of the difference in their affinity for such fiber structure, which results in its uneven color and poor color reproducibility.

In addition, the prior art requires the polyamide fiber structure dyed or printed with water-soluble dyes to be subjected to treatment such as steaming for fixation of the dyes onto the fiber, which involves control of the condition for the fixation such as temperature and time.

However, such fixation condition is extremely difficult to control perfectly on an industrial basis, inevitably undergoing variation.

Such variation in the fixation condition also presents a problem of resulting in uneven color and/or poor color reproducibility of the resultant dyed or printed fiber.

The prior art has also a problem of the dyes applied to a fiber structure to print a design pattern on it bleeding out of the outline of the pattern (hereinafter referred to as "bleeding").

Accordingly, no prior art has yet been disclosed to establish a method of printing a polyamide structure using two or more types of water-soluble dyes to allow the polyamide structure to be printed with no uneven color, high color reproducibility and excellent ink bleeding prevention.

SUMMARY OF THE INVENTION

The inventors investigated the causes of the above-mentioned problems involved in printing a polyamide fiber structure with water-soluble dyes such as its uneven color, poor color reproducibility and bleeding. As a result of the investigation, the inventors discovered that these problems are closely associated with the water-soluble dyes' inorganicity values divided by their respective organicity values (hereinafter referred to as their "inorganicity/organicity values).

It is therefore an object of the present invention to provide a method of printing a polyamide structure using two or more types of water-soluble dyes to allow the polyamide structure to be printed with no uneven color, high color reproducibility and excellent ink bleeding prevention.

The present invention relates to a method of printing a natural or synthetic polyamide structure such as fiber, fabric or sheet using water-soluble dyes to allow the polyamide structure to be printed with no uneven color, high color reproducibility and excellent ink bleeding prevention, such a method based on an inkjet system and an inkset for use with such a method.

The present invention chiefly consists of a method of printing a polyamide structure using two or more of water-soluble dye with an inorganicity/organicity value of 1 to 7 selected so that the ones with the largest and smallest inorganicity/organicity values show a difference of 2 or below between their two such values.

DETAILED DESCRIPTION OF THE INVENTION

More particularly, the present invention relates to the inventions specified as below in items 1 to 9:

1. A method of printing a polyamide structure, which comprises using two or more types of water-soluble dyes with an inorganicity/organicity value of 1 to 7 selected so that the ones with the largest and smallest inorganicity/organicity values show a difference of 2 or below between their two such values;
2. A method of printing a polyamide structure as specified in item 1 above, wherein the inorganicity/organicity values of the water-soluble dyes range from 3.5 to 6.0;
3. A method of printing a polyamide structure as specified in item 1 or 2, wherein the water-soluble dyes are reactive dyes;
4. A method of printing a polyamide structure as specified in item 1, 2 or 3, wherein the method is based on an inkjet system;
5. A method of printing a polyamide structure as specified in item 4, wherein the inkjet system uses ink containing one or more of (mono- or poly-) lower alkylene glycol (mono- or di-)alkyl ethers as a wetting agent;
6. An inkset for inkjet printing of a polyamide structure, consisting of two or more inks containing water-soluble dyes and a wetting agent, wherein said water-soluble dyes range in their inorganicity/organicity values from 1 to 7, of which the ones with the largest and smallest inorganicity/organicity values show a difference of 2 or below between their two such values;
7. An inkset for inkjet printing of a polyamide structure as specified in item 6, wherein the inorganicity/organicity values of the water-soluble dyes range from 3.5 to 6.0;
8. An inkset for inkjet printing of a polyamide structure as specified in item 6 or 7, wherein the wetting agent comprises one or more of (mono- or poly-) lower alkylene glycol (mono- or di-)alkyl ethers; and
9. A polyamide structure printed using such a printing method as specified in items 1 to 5 or such an inkjet inkset as specified in items 6 to 8.

The present invention consists in a method of printing a polyamide structure using two or more of water-soluble dye with an inorganicity/organicity value of 1 to 7 selected so that the ones with the largest and smallest inorganicity/organicity values show a difference of 2 or below between their two such values.

The inorganicity/organicity values of water-soluble dyes useful for the present invention is 1 or above, preferably 3.5 or above, and approximately 7 as its upper limit, preferably 6 or below, in which range the water-soluble dyes show an adequate affinity for a polyamide fiber structure to allow the fiber structure to be dyed or printed with no uneven color and good color reproducibility.

In addition, according to the present invention, two or more water-soluble dyes for use in dyeing or printing polyamide fiber are selected so that the ones with the largest and smallest inorganicity/organicity values show a difference of 2 or below between their two such values in order to eliminate a significant difference in the dyes' affinity for the polyamide fiber, reducing the difference between them in their contribution to its uneven color and the difference between their fixation onto it during the process for such fixation such as its steaming with resultant improvement in its color reproducibility.

Furthermore, such selection of water-soluble dyes for printing a polyamide fiber structure with a design pattern allows the fiber structure to be printed with little bleeding of the dyes out of the outline of the pattern.

Therefore, as specified in the present invention, a method of printing a polyamide structure using two or more types of water-soluble dyes to allow the structure to be printed with no uneven color, good color reproducibility and dye bleeding prevention can be achieved if the dyes are selected so that their inorganicity/organicity values range from 1 to 7, preferably 3.5 to 6.0, the difference between the largest and smallest of which is 2 or below, preferably 1 or below.

The inorganicity/organicity values of water-soluble dyes according to the present invention were calculated pursuant to the method described in "Theoretical Chemistry of Dyeing" (written by Nobuhiko Kuroki and published by Maki Shoten) on pages 66 to 70, which provide information and data relevant to the calculation method including Table 3.3 "Inorganicity Values of Inorganic Groups" and "Sample Calculations". The organicity and inorganicity values of a dye molecule are generally based on the principle of 20 for each carbon atom contained in the dye molecule and 100 for each hydroxyl group contained in it, respectively. This principle is appropriately used as a basis for determination of the organicity and inorganicty values of any other group contained in a dye molecule such as a substituent.

In the present invention, the inorganicy/organicity value of a water-soluble dye containing a sulfonic group was calculated with the group assumed to be $SO_3Na$.

The polyamide structures according to the present invention can comprise fiber, fabric and sheet made of polyamides, whether natural or synthetic. Among the useful natural polyamides are wool and silk. The useful synthetic polyamides include nylon 6, nylon 66 and other synthetic polyamide fibers composed of copolymers based thereon.

The synthetic polyamide fiber structures useful in the present invention can comprise any type of structure such as woven, knitted or non-woven fabric, or artificial leather.

The water-soluble dyes according to the present invention include any of a variety of water-soluble dyes including acid dyes, reactive dyes and direct dyes.

For the present invention, acid and reactive dyes are preferable, of which the latter is more preferable.

The acid dyes useful in the present invention include, without limitation on their chemical structures, dyes with chemical structures containing monoazo (such as pyrazoloneazo and benzeneazo), anthraquinone (such as quinizarin and bromamine), polyazo, triarylmethane, xanthene, nitro and metal complex.

Among typical examples of these acid dyes that are commercially available are C. I. Acid Orange 67, C. I. Acid Yellow 127, C. I. Acid Red 138, C. I. Acid Red 265, C. I. Acid Blue 140 and C. I. Acid Blue 185 .

The reactive dyes useful in the present invention include, without limitation on their chemical structures or reactive groups, dyes with chemical structures such as pyrazolone, benzenazo, naphthaleneazo, pyridoneazo, J-acid azo, H-acid azo, K-acid azo, anthraquinone, metal complex monoazo, formazan, phthalocyanine, disazo, azine and dioxazine, and dyes with reactive groups such as vinylsulfone, dichlorotriazine, monochlorotriazine, monofluorotriazine, trichloropyrimidine, vinylsulfone+monochlorotriazine and other multifunctional molecules. Among typical examples of these reactive dyes that are commercially available are C. I. Reactive Yellow 2, C. I.

Reactive Yellow 17, C. I. Reactive Yellow 85, C. I. Reactive Yellow 95, C. I. Reactive Orange 5, C. I. Reactive Orange 13, C. I. Reactive Red 3:1, C. I. Reactive Red 22, C. I. Reactive Red 24, C. I. Reactive Red 33, C. I. Reactive Blue 2, C. I. Reactive Blue 5, C. I. Reactive Blue 19 and C. I. Reactive Blue 49.

The direct dyes useful in the present invention include, without limitation on their chemical structures, dyes with chemical structures such as polyazo, trizine, dianisidineazo, stylbeneazo, thiazolazo, diaminodiphenylamineazo and di-J acid-azo.

Useful water-soluble dyes of the present invention as mentioned above can be printed on a polyamide structure either by applying two or more of the dyes separately to the structure to mix them together on it or by applying them mixed as a paste or ink to it.

Any two or more water-soluble dyes to be applied to a polyamide structure according to the present invention should be selected in such a way that their inorganicity/organicity values range from 1 to 7, preferably 3.5 to 6.0, the difference between the largest and smallest of which is 2 or below, preferably 1 or below.

Any useful two or more water-soluble dyes according to the present invention can comprise any and all types of water-soluble dyes, preferably acid or reactive dyes, which are of the same type.

Among the useful water-soluble dyes, reactive dyes are more preferable, of which the ones are most preferable, which are highly soluble in a printing paste or ink prepared for application to a polyamide structure and capable of giving high fastness properties on polyamide.

Methods for applying useful water-soluble dyes to a polyamide structure according to the present invention include screen, rotary, roller, hand and inkjet printing systems.

Among them, the inkjet printing system is preferable for the present invention because it is intended for representation of subtle color gradation, requiring very severe control of affinity between dyes and fabric or among dyes, to which they are to be applied.

When an inkjet system is adopted for printing useful water-soluble dyes mixed as an ink onto a polyamide structure according to the present invention, the ink can contain a wetting agent, pH controller, chelating agent, preservative, UV absorber, viscosity controller, water-soluble organic solvent and other additives if necessary to achieve the objects of the present invention or further improve the properties and characteristics of the resultant inkjet-printed polyamide structure.

Each such ink used in the present invention can contain two or more types of water-soluble dyes. However, preferably, two or more inks, each containing one type of water-soluble ink, can be used as a set.

Wetting agents as a useful additive to an inkjet ink of the present invention can comprise both solid and liquid ones.

Useful solid wetting agents include not only hydroxypropyl-β-cyclodextrin, trimethylolethane, trimethylolpropane, caprolactam and urea, but also monosaccharides such as pentose and hexose, polysaccharides such as disaccharides and trisaccharides, derivatives thereof such as their reduced derivatives (for example, sugar alcohol or deoxy sugar), oxidized derivatives (for example, aldonic acid or uronic acid) and dehydrated derivative, amino acids and thiosugars.

Useful liquid wetting agents include polyethylene glycols such as diethylene glycol, trietylene glycol and tetraethylene glycol, poly-lower-alkylene glycols such as dipropylene glycol, (mono- or poly-)lower alkylene glycol (mono- or di-)alkyl ether such as diethylene glycol monomethyl ether, triethylene glycol monomethyl ether, polyethylene glycol monomethyl ether, diethylene glycol dimethyl ether, triethylene glycol dimethyl ether, tetraehtylene glycol dimethyl ether and dipropylene glycol (mono- or di-)methyl ether, preferably (mono- or poly-)lower alkylene glycol (mono- or di-)lower alkyl ether, as well as high-boiling low-volatile lower polyhydric alcohols such as ethylene glycol, glycerin, propylene glycol and 1,3-butanediol.

Among the above-listed wetting agents, (mono- or poly-) lower alkylene glycol dialkyl ether is preferable for the present invention.

The application of a useful inkjet ink for the present invention to a polyamide structure with (mono- or poly-) lower alkylene glycol dialkyl ether added to the ink as a wetting agent allows the polyamide structure to be inkjet-printed with better prevention of ink bleeding.

It should be noted that the term "lower" referred to in the present invention for a hydrocarbon radical means that its number of carbon atoms ranges from 1 to 6, preferably 1 to 4, and that the term "poly" used herein for a hydrocarbon-based polymer such as polyethylene glycol means that its number of carbon atoms ranges 2 to 20, preferably 2 to 10.

Among pH controllers as a useful additive to an inkjet ink used in the present invention are organic amines such as diethanolamine and triethanolamine, inorganic bases such as sodium hydroxide, potassium hydroxide and potassium hydrogen phosphate, organic acids such as tartaric acid, lactic acid, phthalic acid, acetic acid, formic acid and oxalic acid, mineral acids such sulfuric acid and salts thereof.

Useful preservatives for an inkjet ink used in the present invention comprise sodium o-phenylphenol, formalin, p-hydroxy methylbenzoate, sodium-2-pyridinethiol-1-oxide, hexahydro-1,3,5-tris-s-triazine, tetrachloroisophthalonitrile and zinc-2-pyridinethiol-1-oxide, as well as isothiazoline compounds such as 5-chloro-2-methyl-4-isothiazoline-3-one, 2-methyl-4-isothiazoline-3-one and 1,2-benzisothiazoline.

Among water-soluble organic solvent are ketones such as acetone, ketone alcohol such as diacetone alcohol, and ethers such as tetrahydrofuran and dioxane.

The following shows the major components of a preferred inkjet ink for the present invention as a weight percent of the total quantity of the ink:

Water soluble dye: Not less than 0.1%, preferably not less than 3%, more preferably not less than 5%, but not more than 30%

Wetting agent: Not less than 0.1%, preferably not less than 0.5%, but not more than 20%, preferably 10%

Water-soluble organic solvent: 0 to 40% or so

Other additives: 0.1 to 10% or so

Water Rest

According to the present invention, a polyamide fiber structure printed with useful water-soluble dyes using any useful printing system as herein specified should thereafter be preferably subjected to treatment for fixation of the dyes onto the fiber of the structure.

Such fixation of a polyamide fiber structure printed as mentioned herein above can be achieved by conventionally available methods such as steaming, in which the structure is normally treated under saturated steam at 100° C. to 110° C. for 20 to 30 minutes.

According to the present invention, the polyamide fiber structure subjected to such fixation should preferably undergo washing to remove any dyes unfixed on the fiber of the structure.

Such washing of a polyamide fiber structure printed and fixed as mentioned herein above can be accomplished by a conventionally available method, in which the fiber structure is treated in water at 40° C. to 50° C., which contains properly selected assistants such as washing and unfixed-dye redeposition preventing agents.

The use of water-soluble dyes properly selected according to the present invention for printing a polyamide structure with design patterns allows the printed polyamide structure to be subjected to such fixation and washing as mentioned above with minimized effects of some variations in the temperature and time duration of the fixation and washing on the design patterns, making their color reproducibility excellent.

The inkjet-printed polyamide structure thus obtained according to the present invention can be thereafter treated with a dye fixing agent (such as a polyamine- or polycation-based compound or a natural or synthetic tannin), a TV absorber, an oxidation inhibitor and other auxiliaries if necessary to improve its wet, chlorine, light and other colorfastness properties.

Therefore, the method of printing a polyamide structure with design patterns according to the present invention, which requires the selection of certain water-soluble dyes for the printing as described herein, allows the printed polyamide structure to be subjected to subsequent fixation and washing processes with minimized effects of some variations in the temperature and time duration of the processes on the design patterns, making them free of uneven color and dye bleeding and their color reproducibility excellent.

EXAMPLES OF EMBODIMENTS OF THE INVENTION

To further illustrate the present invention, and not by way of limitation, the following examples of its embodiments are presented in comparison with examples of its conventional counterparts.

Table 1 shows the dyes used in these examples, their C. I. Nos., hues and inorganicity/organicity values.

TABLE 1

| Dyes | C. I. No. | Hue | Inorganicity/Organicity value |
|---|---|---|---|
| Reactive dye A | C. I. Reactive Yellow 17 | Yellow | 4.4 |
| Reactive dye B | C. I. Reactive Yellow 85 | Yellow | 5.6 |
| Reactive dye C | C. I. Reactive Orange 99 | Orange | 7.8 |
| Reactive dye D | C. I. Reactive Red 22 | Red | 4.3 |
| Reactive dye E | C. I. Reactive Red 24 | Red | 5.1 |
| Reactive dye F | C. I. Reactive Red 226 | Red | 7.8 |
| Reactive dye G | C. I. Reactive Blue 19 | Blue | 4.2 |
| Reactive dye H | C. I. Reactive Blue 176 | Blue | 8.2 |
| Acid dye K | C. I. Acid Orange 67 | Orange | 1.7 |
| Acid dye L | C. I. Acid Yellow 127 | Yellow | 2.5 |
| Acid dye M | C. I. Acid Red 138 | Red | 3.2 |
| Acid dye N | C. I. Acid Red 265 | Red | 4.1 |
| Acid dye O | C. I. Acid Blue 140 | Blue | 1.9 |
| Acid dye P | C. I. Acid Blue 185 | Blue | 4.5 |

Examples 1–4 and Comparative Examples 1–4 (based on "screen printing")

(1) The dyes listed in Table 1 were used to prepare color pastes for screen printing according to the recipes given in Table 2 below.

TABLE 2

Unit: Weight % *1

| Dye (form)*2 | | Examples 1 | Examples 2 | Examples 3 | Examples 4 | Comparative Examples 1 | Comparative Examples 2 | Comparative Examples 3 | Comparative Examples 4 |
|---|---|---|---|---|---|---|---|---|---|
| Reactive dye | B (powder) | | 5.0 | | | | 5.0 | | |
| | D (powder) | 5.0 | | | | 5.0 | | | |
| | F (powder) | | | | | | 5.0 | | |
| | G (powder) | 5.0 | 5.0 | | | | | | |
| | H (powder) | | | | | 5.0 | 5.0 | | |
| Acid dye | K (powder) | | | 5.0 | | | | 5.0 | 5.0 |
| | M (powder) | | | 5.0 | | | | | |
| | N (powder) | | | | 5.0 | | | 5.0 | |
| | P (powder) | | | | 5.0 | | | | 5.0 |
| Meypro Gum NP *3 | | 77.0 (added to each color paste) | | | | | | | |
| Polimine L new *4 | | 0.5 (added to each color paste) | | | | | | | |
| Ammonium sulfate | | 1.0 (added to each color paste) | | | | | | | |
| Purified water | | Rest | Rest | Rest | Rest | Rest | Rest | Rest | Rest |
| Total | | 100 | 100 | 100 | 100 | 100 | 100 | 100 | 100 |
| Difference between the largest and smallest inorganicity/organicity values | | 0.1 | 1.4 | 1.5 | 0.4 | 3.9 | 2.6 | 2.4 | 2.8 |

*1: The amounts of the components of each color paste are indicated as a weight percent of the total of the paste.
*2: The capital letters in the "Dye" column such as B, D, F and so on represent those assigned to the dyes in Table 1 as their symbols.
*3: Meypro Gum NP is a Meyhall A.G.-made thickening agent with a solid content of 10%.
*4: Polimine L new is a Nippon Kayaku Co., Ltd.-made reduction inhibitor.

(2) Each of the color pastes prepared according to Table 2 above was printed on a polyamide fiber structure using a 1200-mesh screen printing system.

The fiber structure was a nylon 6 knitted fabric containing polyurethane (Opelon: a product of Toray Co., Ltd.).

The printed fabric was dried at 80° C. for 10 minutes before being subjected to treatment under saturated steam at 102° C. for 20 minutes, followed by washing at ordinary temperature. The soaped fabric was washed in ion-exchanged water at 40° C. for 10 minutes with the ratio of the weight of the water to that of the fabric set to 50:1, and then dried. The fabric was evaluated for two items "uneven color" and "bleeding" as described below:

(1) Uneven color

The uneven color of the fabric was evaluated visually according to the following three-grade (○ΔX) rating scale:

○: No uneven color on the front side and color shade difference between the front and back sides Δ: Slight uneven color on the front side and color shade difference between the front and back sides X: Appreciable uneven color on the front side and color shade difference between the front and back sides (2) Bleeding The bleeding of the fabric was evaluated visually according to the following three-grade (○ΔX) rating scale:

○: No bleeding with sharp pattern outline

Δ: Slight bleeding

X: Severe bleeding with blunt pattern outline

The results of the evaluation are shown in Table 3 below.

TABLE 3

| | Uneven color | Bleeding |
|---|---|---|
| Example 1 | ○ | ○ |
| Example 2 | ○ | ○ |
| Example 3 | ○ | ○ |
| Example 4 | ○ | ○ |
| Comparative Example 1 | X | X |
| Comparative Example 2 | X | X |
| Comparative Example 3 | X | ○ |
| Comparative Example 4 | X | ○ |

As can be seen from Table 3, the present invention as embodied in Examples 1 to 4 allows a polyamide fiber structure to be printed by screen printing with neither uneven color nor bleeding, making it into a high-quality printed article.

Examples 5–13 and Comparative Examples 5–11 (based on "inkjet printing")

The dyes listed in Table 1 were used to prepare color inks "a" to "p" for inkjet printing according to the recipes given in Table 4 below.

TABLE 4

Unit: Weight % *1

| Dye (form) *2 | | Ink a | b | c | d | E | F | g | h | i | j | k | l | m | n | o | P |
|---|---|---|---|---|---|---|---|---|---|---|---|---|---|---|---|---|---|
| Reactive dye | A (powder) | 100 | | | | | | | | | | | | | | | |
| | B (powder) | | 100 | | | | | | | 100 | | | | | | | |

TABLE 4-continued

Unit: Weight % *1

| | | Ink | | | | | | | | | | | | | | | |
|---|---|---|---|---|---|---|---|---|---|---|---|---|---|---|---|---|---|
| Dye (form) *2 | | a | b | c | d | E | F | g | h | i | j | k | l | m | n | o | P |
| | C (powder) | | | 100 | | | | | | | | | | | | | |
| | D (liquid) *3 | | | | 500 | | | | | | | | | | | | |
| | E (powder) | | | | | 100 | | | | | 100 | | | | | | |
| | F (liquid) *3 | | | | | | 500 | | | | | | | | | | |
| | G (liquid) *3 | | | | | | | 500 | | | | | | | | | |
| | H (powder) | | | | | | | | 100 | | | | | | | | |
| Acid dye | K (powder) | | | | | | | | | | | 60 | | | | | |
| | L (powder) | | | | | | | | | | | | 30 | | | | |
| | M (powder) | | | | | | | | | | | | | 30 | | | |
| | N (powder) | | | | | | | | | | | | | | 60 | | |
| | O (powder) | | | | | | | | | | | | | | | 40 | |
| | P (powder) | | | | | | | | | | | | | | | | 60 |
| Wetting agent I *4 | | 1.5 | 1.5 | 1.5 | 1.5 | 1.5 | 1.5 | 1.5 | 1.5 | | | 1.5 | 1.5 | 1.5 | 1.5 | 1.5 | 1.5 |
| Wetting agent II *5 | | | | | | | | | | 1.5 | 1.5 | | | | | | |
| Preservative *6 | | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| Purified water | | Rest | Rest | Rest | Rest | Rest | Rest | Rest | Rest | Rest | Rest | Rest | Rest | Rest | Rest | Rest | Rest |
| Total | | 100 | 100 | 100 | 100 | 100 | 100 | 100 | 100 | 100 | 100 | 100 | 100 | 100 | 100 | 100 | 100 |

*1: The amounts of the components of each color ink are indicated as a weight percent of the total of the ink.
*2: The capital letters in the "Dye" column such as A, B, C and so on represent those assigned to the dyes in Table 1 as their symbols.
*3: D (liquid), F (liquid) and G (liquid) are their corresponding dyes in powder form dissolved in water at a concentration of 20%.
*4: Wetting agent I is a compound based on diethylene glycol dimethyl ether.
*5: Wetting agent II is a compound based on glycerin.
*6: The preservative is San-ai Oil Corporation-made San-ai-bac 20.

The inks prepared according to Table 4 were combined as shown in Table 5 below to prepare inksets for inkjet printing on a polyamide fiber structure.

The fiber structure was a nylon 6 knitted fabric containing polyurethane (Opelon: a product of Toray Co., Ltd.).

The application of each inkset to the fabric was made using an on-demand serial scanning inkjet printing system under the following printing condition.

Nozzle diameter: 100 $\mu$m, driving voltage: 107V, frequency: 5000 Hz and resolution: 360 dpi.

TABLE 5

Unit: g/m$^2$ *1

| | | Examples | | | | | | | | | Comparative Examples | | | | | | |
|---|---|---|---|---|---|---|---|---|---|---|---|---|---|---|---|---|---|
| Ink | Inorganicity/organicity value *2 | 5 | 6 | 7 | 8 | 9 | 10 | 11 | 12 | 13 | 5 | 6 | 7 | 8 | 9 | 10 | 11 |
| a | 4.4 | 20 | 20 | 10 | | | | | | | 20 | 20 | | | | 10 | |
| b | 5.6 | | | | 20 | | | | | 10 | | | | | | | |
| c | 7.8 | | | | | | | | | | | | 10 | | | | 10 |
| d | 4.3 | 20 | | | | | | | | | | | | | | | |
| e | 5.1 | | | 10 | 20 | | | | | 10 | | | | | | | 10 |
| f | 7.8 | | | | | | | | | | 20 | | 10 | | | | |
| g | 4.2 | | 20 | 10 | | | | | 30 | | | | 10 | | | | |
| h | 8.2 | | | | | | | | | | | 20 | | | | | |
| i | 5.6 | | | | | 20 | | | | | | | | | | | |
| j | 5.1 | | | | | 20 | | | | | | | | | | | |
| k | 1.7 | | | | | | | 10 | | | | | | 20 | 20 | | |
| l | 2.5 | | | | | | 20 | | | | | | | | | | |
| m | 3.2 | | | | | | 20 | 10 | | | | | | | | | |
| n | 4.1 | | | | | | | | 20 | | | | | 20 | | 10 | |
| o | 1.9 | | | | | | | 10 | | | | | | | | 10 | |
| p | 4.5 | | | | | | | | 10 | | | | | | 20 | | 10 |
| Difference between the largest and smallest inorganicity/organicity values *3 | | 0.1 | 0.2 | 0.9 | 0.5 | 0.5 | 0.7 | 1.5 | 0.1 | 1.1 | 3.4 | 3.8 | 3.6 | 2.4 | 2.8 | 2.5 | 3.3 |

*1: The figures in the columns of "Examples" and "Comparative Examples" indicate the amounts of the inks printed on the fabric in g/m$^2$.
*2: The figures in the column of "Inorganicity/organicity value" indicate the inorganicity/organicity value of the water-soluble dye contained in each ink.
*3: The figures in the column of "Difference between the largest and smallest inorganicity/organicty values" indicate the difference between the largest and smallest inorganicity/organicity values of the water-soluble dyes contained in each inkset.

The inkjet-printed fabric was steamed at 102° C. for 20 minutes and soaped at ordinary temperature before being washed in ion-exchanged water at 40° C. for 10 minutes with the ratio of the weight of the water to that of the fabric set to 50:1, and then dried. The fabric was evaluated for two items "uneven color" and "bleeding" in the same way as in the case of the screen printing described above. The results of the evaluation are shown in Table 6.

TABLE 6

| | Uneven color | Bleeding |
|---|---|---|
| Example 5 | ○ | ○ |
| Example 6 | ○ | ○ |
| Example 7 | ○ | ○ |
| Example 8 | ○ | ○ |
| Example 9 | ○ | Δ |
| Example 10 | ○ | ○ |
| Example 11 | ○ | ○ |
| Example 12 | ○ | ○ |
| Example 13 | ○ | ○ |
| Comparative Example 5 | X | X |
| Comparative Example 6 | X | X |
| Comparative Example 7 | X | X |
| Comparative Example 8 | X | X |
| Comparative Example 9 | X | X |
| Comparative Example 10 | X | X |
| Comparative Example 11 | X | X |

As can be seen from Table 6, the present invention as embodied in Examples 5 to 13 allows a polyamide fiber structure to be inkjet-printed with neither uneven color nor bleeding, making it a high-quality printed article.

Notwithstanding the above, however, Example 9, in which the ink contained glycerin as a wetting agent, showed a slight bleeding in the resultant printed article, suggesting the preferred use of (mono- or poly-)lower alkylene glycol dialkylether as a wetting agent for inkjet printing.

Examples 14–15 and Comparative Examples 12–13 (based on inkjet printing)

The inks prepared according to Table 4 were combined as shown in Table 7 below to prepare inksets for inkjet printing on a nylon 6 knitted fabric containing polyurethane (Opelon: a product of Toray Co., Ltd.) using an inkjet printing system under the same printing condition as in the case of Examples 5–13 and Comparative Examples 5–11 described above.

The figures and other indications in Table 7 are the same as in Table 5.

TABLE 7

| | | Examples | | Unit: g/m$^2$ Comparative Examples | |
|---|---|---|---|---|---|
| Ink | Inorganicity/organicity value | 14 | 15 | 12 | 13 |
| a | 4.4 | 20 | | | |
| b | 5.6 | | 20 | 20 | 20 |

TABLE 7-continued

| | | Examples | | Unit: g/m$^2$ Comparative Examples | |
|---|---|---|---|---|---|
| Ink | Inorganicity/organicity value | 14 | 15 | 12 | 13 |
| c | 7.8 | | | | |
| d | 4.3 | 20 | | | |
| e | 5.1 | | 20 | 20 | |
| f | 7.8 | | | | 20 |
| g | 4.2 | 20 | 20 | | 20 |
| h | 8.2 | | | 20 | |
| Difference between the largest and smallest inorganicity/organicity values | | 0.2 | 1.4 | 3.1 | 3.6 |

The inkjet-printed fabric was steamed under the three conditions simulating variations in the steamer temperature —101° C.×20 min., 105° C.×20 min. and 109° C.×20 min. The fabric was then soaped at ordinary temperature before being washed in ion-exchanged water at 40° C. for 10 minutes with the ratio of the weight of the water to that of the fabric set to 50:1.

The fabric was evaluated for color reproducibility using reflective shade depth meter (Macbeth RD918; a product of Gretag Macbeth Co., Ltd.) to measure its yellow component (Y), magenta component (M), cyan component (C) and black component (K).

The fabric was also evaluated visually for the color shade difference between its front and back sides.

The evaluation was based on the following three-grade (○ΔX) rating scale:

○: Extremely small variations in the shade depth and hue of the printed fabric caused by change in the temperature of its steaming (as evidenced by the Macbeth shade depth meter measurement data, showing that the largest color shade variation caused by the steaming condition is 0 to 0.04) and no color shade difference between its front and back sides Δ: Slight variations in the shade depth and hue of the printed fabric caused by change in the temperature of its steaming (as evidenced by the Macbeth shade depth meter measurement data, showing that the largest color shade variation caused by the steaming condition is 0.05 to 0.08) and little color shade difference between its front and back sides X: Appreciable variations in the shade depth and hue of the printed fabric caused by change in the temperature of its steaming (as evidenced by the Macbeth shade depth meter measurement data, showing that the largest color shade variation caused by the steaming condition is 0.09 or more) and appreciable color shade difference between its front and back sides The results of the evaluation are shown in Table 8 together with the shade depth meter measurement data obtained using Macbeth RD918.

TABLE 8

| | Examples | |
|---|---|---|
| Steaming condition | 14 | 15 |
| 101° C. × 20 min. | Y:1.40 M:1.42 C:1.39 K:1.37 | Y:1.38 M:1.41 C:1.45 K:1.43 |
| 105° C. × 20 min. | Y:1.39 M:1.43 C:1.41 K:1.39 | Y:1.36 M:1.40 C:1.47 K:1.46 |

TABLE 8-continued

| | | |
|---|---|---|
| 109° C. × 20 min. | Y:1.38 M:1.41 C:1.41 K:1.40 | Y:1.35 M:1.39 C:1.49 K:1.48 |
| Color reproducibility | ○ | Δ |

| | Comparative Examples | |
|---|---|---|
| Steaming condition | 12 | 13 |
| 101° C. × 20 min. | Y:1.43 M:1.28 C:0.94 K:1.09 | Y:1.38 M:1.03 C:1.45 K:1.21 |
| 105° C. × 20 min. | Y:1.41 M:1.32 C:0.96 K:1.14 | Y:1.36 M:1.05 C:1.44 K:1.26 |
| 109° C. × 20 min. | Y:1.43 M:1.33 C:1.02 K:1.19 | Y:1.37 M:1.15 C:1.46 K:1.39 |
| Color reproducibility | X | X |

As can be seen from Table 8, the present invention as embodied in Examples 14–15 allows a polyamide fiber structure to be inkjet-printed with good color reproducibility, irrespective of some variation in the fixing condition, in comparison with Comparative Examples 12–13, which show very large variations particularly in the black component.

What is claimed is:

1. A method of printing a polyamide structure, which comprises applying two or more types of water-soluble dyes with an inorganicity/organicity value of 1 to 7 selected so that the ones with the largest and smallest inorganicity/organicity values show a difference of 2 or below between their two such values and at least one of these dyes has an inorganicity/organicity value of 3.2 or more.

2. A method of printing a polyamide structure as claimed in claim 1, wherein the inorganicity/organicity values of the water-soluble dyes range from 3.5 to 6.0.

3. A method of printing a polyamide structure as claimed in claim 1 or 2, wherein the water-soluble dyes are reactive dyes.

4. A method of printing a polyamide structure as claimed in claim 1, 2 or 3, wherein the method is based on an inkjet system.

5. A method of printing a polyamide structure as claimed in claim 4, wherein the inkjet system uses ink containing one or more of (mono- or poly-) lower alkylene glycol (mono- or di-)alkyl ethers as a wetting agent.

6. An inkset for inkjet printing of a polyamide structure, consisting of two or more inks containing water-soluble dyes and a wetting agent, wherein said water-soluble dyes range in their inorganicity/organicity values from 1 to 7, of which the ones with the largest and smallest inorganicity/organicity values show a difference of 2 or below between their two such values and at least one of these dyes has an inorganicity/organicity value of 3.2 or more.

7. An inkset for inkjet printing of a polyamide structure as claimed in claim 6, wherein the inorganicity/organicity values of the water-soluble dyes range from 3.5 to 6.0.

8. An inkset for inkjet printing of a polyamide structure as claimed in claim 6 or 7, wherein the wetting agent comprises one or more of (mono- or poly-) lower alkylene glycol (mono- or di-)alkyl ethers.

9. A polyamide structure printed with the printing method as claimed in any one of claims 1, 2 or 3.

10. A polyamide structure printed with the printing method as claimed in claim 4.

11. A polyamide structure printed with the printing method as claimed in claim 5.

12. A polyamide structure printed with the inkjet inkset as claimed in claim 6 or 7.

13. A polyamide structure printed with the inkjet inkset as claimed in claim 8.

14. A method of printing a polyamide structure as claimed in claim 2, wherein the water-soluble dyes are reactive dyes.

15. A method of printing a polyamide structure as claimed in claim 14, wherein the method is based on an inkjet system.

16. A method of printing a polyamide structure as claimed in claim 15, wherein the inkjet system uses ink containing one or more of (mono- or poly-) lower alkylene glycol (mono- or di-)alkyl ethers as a wetting agent.

17. A polyamide structure printed with the inkjet inkset as claimed in claim 14.

18. A polyamide structure printed with the inkjet inkset as claimed in claim 15.

19. A polyamide structure printed with the inkjet inkset as claimed in claim 16.

* * * * *